United States Patent [19]

Gale

[11] Patent Number: 5,042,701

[45] Date of Patent: Aug. 27, 1991

[54] LACING APPARATUS WITH FEED ROLLERS TO SMOOTH CREASED CRIMPED MATERIAL AFTER LACING

[76] Inventor: Harold G. Gale, 1332 High Street, Malvern, Victoria, Australia

[21] Appl. No.: 599,684

[22] Filed: Oct. 17, 1990

[30] Foreign Application Priority Data

Oct. 20, 1989 [AU] Australia ..... PJ6973

[51] Int. Cl.[5] ..... A41H 43/00; D06J 1/00

[52] U.S. Cl. ..... 223/32; 223/28; 223/50; 112/174

[58] Field of Search ..... 223/32, 28, 29, 34, 223/50, 35; 112/174, 132, 133

[56] References Cited

U.S. PATENT DOCUMENTS

| | | | |
|---|---|---|---|
| 661,365 | 11/1900 | Byrne | 223/50 |
| 683,946 | 8/1901 | Kops | 223/50 |
| 707,585 | 8/1902 | Grotta | 223/50 |
| 708,130 | 9/1902 | Davis | 223/50 |
| 2,551,808 | 5/1951 | Minns | 223/32 |
| 4,323,021 | 8/1982 | Durand | 223/32 X |
| 4,364,494 | 12/1982 | Shive, Jr. | 223/32 X |
| 4,811,873 | 3/1989 | Ethridge et al. | 112/174 X |

*Primary Examiner*—Werner H. Schroeder
*Assistant Examiner*—Bibhu Mohanty
*Attorney, Agent, or Firm*—William H. Murray; Frank M. Linguiti

[57] ABSTRACT

Apparatus for lacing a flexible line through sheet material, such as shade cloth, of an indefinite length in a continuous operation. The apparatus has a set of pleating rollers, each with a series of teeth spaced apart about the periphery. The pleating rollers are mounted for rotation so that the teeth intermesh in a mesh zone, sheet material feeding through the mesh zone during apparatus use being caused to fold by the teeth into successive pleats. A lacing needle projects toward the pleating rollers and has a leading end positioned in the mesh zone. Sheet material pleats successively formed in the mesh zone are pierced by the leading end and received onto the lacing needle. The lacing needle is collectable to a flexible line for lacing through the material. A set of feed rollers are positioned downstream of the pleating rollers, each with a circumferential groove and being mounted for rotation so that the circumferential grooves are in register one with another. The lacing needle is positioned in the circumferential grooves and supported by the feed rollers. Rotation of the feed rollers strips the sheet material from the lacing needle and onto the flexible line so that the line is laced through the sheet material.

19 Claims, 2 Drawing Sheets

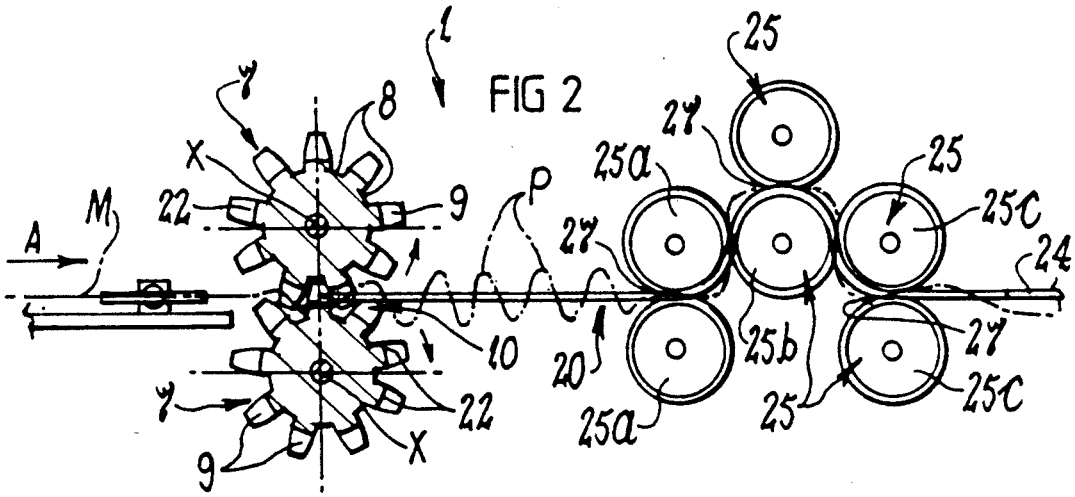
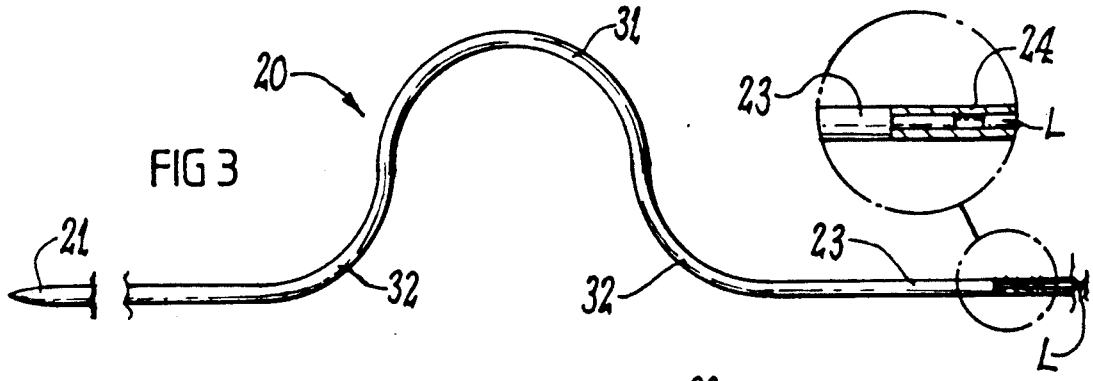
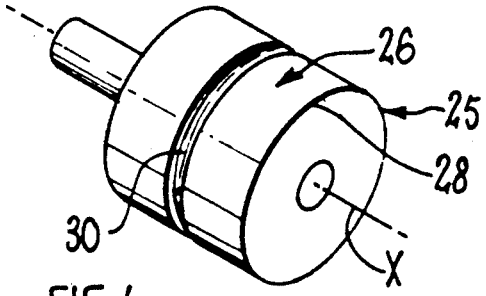
FIG 4
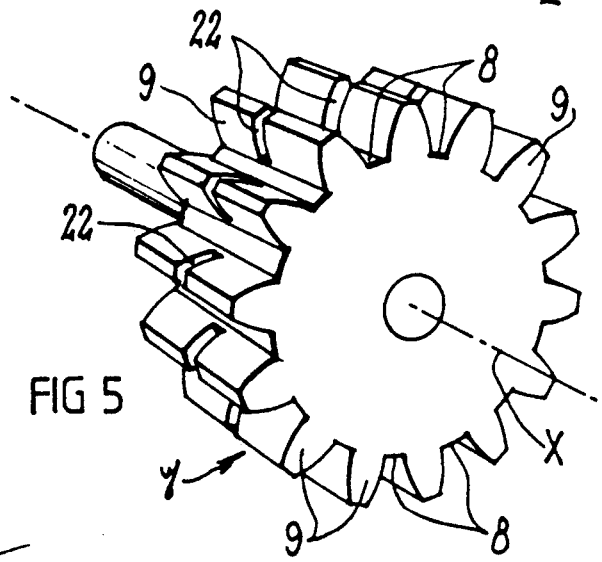
FIG 5
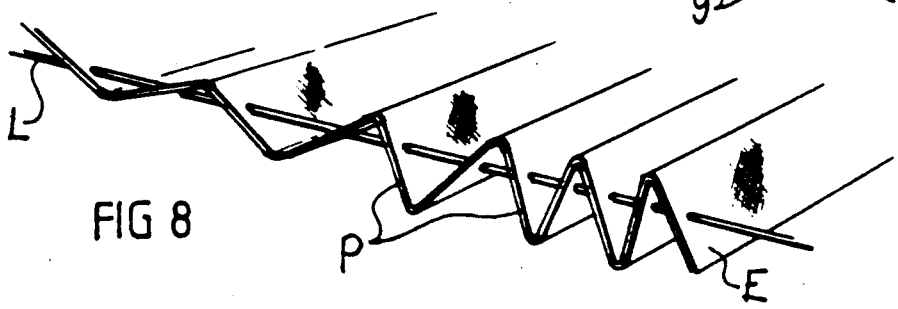
FIG 8

LACING APPARATUS WITH FEED ROLLERS TO SMOOTH CREASED CRIMPED MATERIAL AFTER LACING

BACKGROUND OF THE INVENTION

1. Field of the Invention

This invention relates generally to lacing elongate members through sheet material, and in particular to an apparatus operable to lace a flexible line through sheet material of an indefinite length in a continuous operation. The apparatus is applicable for lacing flexible lines of metal, plastic, cord or other material through woven or knitted plastic sheet material, such as plastic shade cloth, and it will be convenient to hereinafter describe the invention in relation to that exemplary application. It is to be appreciated, however, that the invention is not limited to that application.

2. Description of the Related Art

Woven and knitted plastic shade cloth is mounted over skeletal frame structures to provide underlying plants with protective cover against adverse climatic conditions, particularly excess sun and wind. The shade cloth is often fixed taut to the frame structure by way of battens or plates nailed or otherwise fastened by way of battens or plates nailed or otherwise fastened to the structure. Such an arrangement is suitable where the shade cloth spans only short distances unsupported by the structure.

However, sometimes the shade cloth is required to cover large areas, such as orchards and nurseries and, as is usual for economic reasons in such arrangements, the frame structure is sparse so that the shade cloth must span large distances unsupported by the structure. Although the shade cloth can be drawn taut for initial fixing to the frame structure, the nature of the cloth material and its exposure to all environmental conditions, usually means that the cloth progressively sags across the unsupported distances. Moreover, the cloth may eventually tear away or dislodge from the frame structure so that its effectiveness is reduced.

In an effort to alleviate this problem, flexible lines of wire, plastic, cord, fabric and other suitable material have been laced through the shade cloth for extending over the span distances. Typically, lines can be laced along edge regions of the shade cloth. Those lines are then attached taut to the frame structure and thereby assist in supporting the shade cloth on the structure over their span distances. Moreover, when separate strips or other pieces of shade cloth are mounted adjacent one another on the frame structure, adjacent edge regions are sometimes overlapped and laced together with the flexible lines. This joining of the shade cloth pieces unifies the cloth against tearing or dislodgement, and generally improves the integrity of the protective cover given to the underlying plants.

Up to now the flexible lines have usually been manually laced through the shade cloth. That process is slow, tedious, prone to erratic lacing of the shade cloth, and costly.

Several machines have been developed for generally pleating and lacing various sheet materials other than shade cloth. Examples of these machines are disclosed in U.S. Pat. Nos. 4,811,873, 4,323,021, 3,767,091, 2,583,582, 2,551,808, 2,303,380 and 2,232,178.

These machines typically include a plurality of pleating rollers having intermeshing teeth, the sheet material being progressively fed through the intermeshing teeth which fold the material into pleats. One or more lacing needles are arranged with leading ends adjacent the intermeshing teeth so that, as the material is pleated, the pleats are impaled onto the leading ends and gathered on the needles.

The earlier machines, such as in U.S. Pat. No. 2,303,380, were usually discontinuous in operation, so that a length of sheet material was pleated onto the needles, and the machines then stopped to allow removal of that pleated material from the needles. However, more recent machines, such as in U.S. Pat. No. 4,811,873, operate to continuously pleat the sheet material and move it along the needles. Typically, such machines have their needles arranged so that lacing threads are passed through eyes at one end of the needles. The pleated material can then be progressively removed from the needles so as to be laced onto the threads.

None of these machines are intended or adapted for lacing a flexible line along a longitudinal edge region of shade cloth. Indeed, most of the machines are intended to lace sheet material with a series of threads spaced apart across the material so that the entire material can be smocked. A corollary to this is that those machines generally operate to retain the pleats within the sheet material; at least they do not tend to unpleat the material following lacing as is required with the laced shade cloth.

Moreover the lacing needles in these machines are fixed in position by means of needle holders connected to trailing ends of the needles, or supported in circumferential grooves provided in the pleating rollers. Neither of these arrangements are satisfactory for fast lacing of shade cloth. In particular, such arrangements do not ensure that the pleated sheet material is stripped clear of the needles and thus avoids bunching of pleats on the needles immediately downstream of the pleating rollers.

Thus, these prior art machines are not suitable for lacing longitudinal edge regions of sheet material, such as shade cloth.

SUMMARY OF THE INVENTION

It is an object of the present invention to alleviate these disadvantages through the provision of a relatively simple apparatus which is particularly suitable for lacing flexible lines through shade cloth and other sheet materials.

It is a further object of the present invention to provide an apparatus for lacing a flexible line through sheet material, such as shade cloth, of an indefinite length in a continuous operation.

With these objects in mind, the present invention provides an apparatus for lacing a flexible line through sheet material of an indefinite length in a continuous operation, including: a set of pleating rollers, each pleating roller having a series of teeth spaced apart about the periphery thereof and the pleating rollers being mounted for rotation so that the teeth of the rollers intermesh in a mesh zone, sheet material feeding through the mesh zone during apparatus use being caused to fold by the teeth into successive pleats; a lacing needle projecting toward the pleating rollers and having a leading end positioned in the mesh zone, sheet material pleats successively formed in the mesh zone being pierced by the leading end and received onto the lacing needle, and the lacing needle being connectable to a flexible line for lacing through the sheet material; and, a set of feed rollers positioned downstream of the pleating rollers, each feed roller having a circumferential groove and the feed rollers being mounted for rotation so that the circumferential grooves are in register one with another, the lacing needle being positioned in the circumferential grooves and supported by the feed rollers, whereby rotation of the feed rollers strips the sheet material from the lacing needle and onto the flexible line so that the flexible line is laced through the sheet material.

Preferably, each feed roller has a generally smooth peripheral surface for contacting the sheet material to strip the material from the lacing needle.

Preferably pairs of feed rollers are provided and the lacing needle is supported between them.

In a preferred embodiment, three pairs of feed rollers are provided in a side-by-side arrangement. The two outer pairs of feed rollers may be aligned with one another whilst the intermediate feed roller pair is offset from them.

The lacing needle is preferably shaped to extend through the feed roller set between each pair of rollers. To that end, the lacing needle, between leading and trailing ends, preferably has an inverted U-shaped region which extends along the circumferential groove of one feed roller. Moreover, preferably the lacing needle has curved regions emerging from each end of the inverted U-shaped region and extending toward the leading and trailing ends of the lacing needle. These curved regions extend along respective circumferential grooves of separate feed rollers adjacent the one feed roller.

Preferably the apparatus further includes at least one endless feed belt mounted on at least some of the feed rollers fro endless circulation thereabout. This feed belt moves between the feed rollers and sheet material to contact and strip the sheet material from the lacing needle. In one preferred embodiment, a pair of endless feed belts are provided. Each feed belt is mounted on different feed rollers so that the lacing needle and sheet material extend between those belt. Each feed belt is preferably flexible for deformation by the lacing needle so as to be received in the circumferential grooves.

Preferably, drive means are provided for rotatably driving at least one of the feed rollers. In one preferred embodiment, the drive means is coupled to each of the feed rollers for their positive driving.

Preferably, the pleating rollers are mounted for free rotation. As a result, the pleating rollers rotate under action of movement of the sheet material through the mesh zone.

The apparatus preferably further includes a transition tube. This tube has one end connectable to the trailing end of the needle and an opposite end for receiving an end region of the flexible line. The transition tube and trailing end are preferably shaped to provide a smooth transition for uninhibited movement of the sheet material being stripped from the lacing needle onto the transition tube.

Preferably guide means are provided for guiding the sheet material into the mesh zone between the set of pleating rollers and onto the lacing needle. That guide means preferably includes a stationary guide member. The guide member has a guide surface against which a longitudinal edge region of passing sheet material contacts to align the sheet material with the pleating rollers and lacing needle. For one preferred embodiment, the guide member has an open ended guide slot through which the longitudinal edge region moves.

BRIEF DESCRIPTION OF THE DRAWINGS

The following description refers to preferred embodiments of the apparatus of the present invention. To facilitate an understanding of the invention, reference is made in the description to the accompanying drawings where the apparatus is illustrated. It is to be understood that the invention is not limited In the drawings:

FIG. 2 is a schematic side view of part of the apparatus of FIG. 1;

FIG. 3 is a side view of the lacing needle of the apparatus of FIG. 1;

FIG. 4 is a perspective view of one feed roller of the apparatus of FIG. 1;

FIG. 5 is a perspective view of one pleating roller of the apparatus of FIG. 1;

FIG. 8 is a perspective view of a piece of sheet material having a flexible line laced therethrough using apparatus as shown in the previous Figs.

DESCRIPTION OF THE PREFERRED EMBODIMENTS

Figure 1:
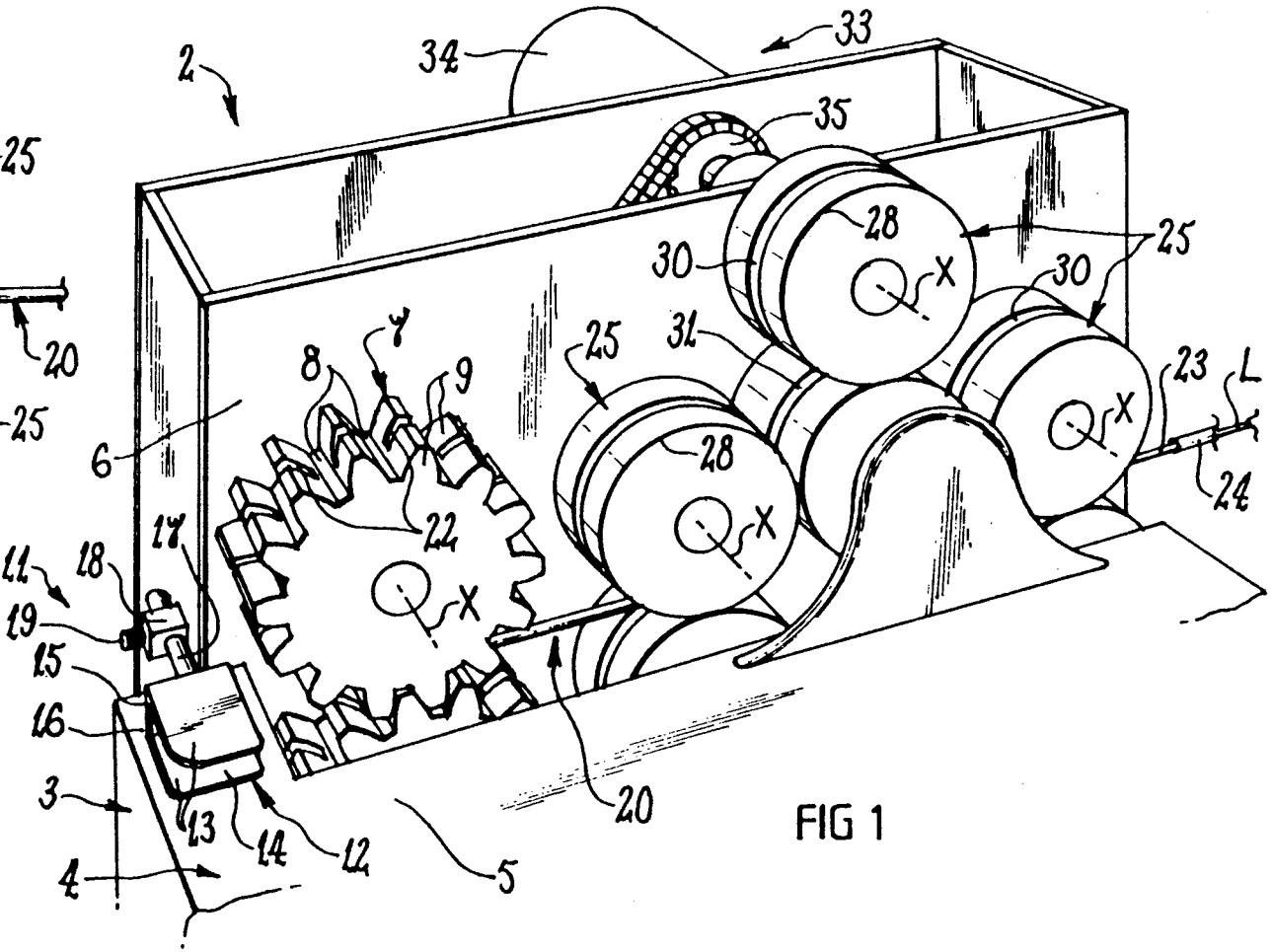
FIG. 1 is a perspective view of the lacing apparatus according to one preferred embodiment of the Present invention.

Referring initially to FIGS. 1 to 5 there is generally shown an apparatus 1 for continuously lacing a flexible line L, through longitudinal edge region E of sheet material M. In order to lace the material M with the line L, apparatus 1 initially operates to fold the material M into a series of pleats P. The pleats P extend transversely of a direction of feed of the material M through apparatus 1, as indicated by arrow A. Those Pleats P may extend entirely through the sheet material M in one embodiment (not shown), whilst in an alternative embodiment (as shown) those pleats P extend only a short distance through the material M. Where relatively short pleats P are provided then (although not shown) one or more series of pleats P can be formed in the material M, each series extending in a line parallel to the direction of feed and spaced apart from one another. The purpose of more than one series of pleats P will become apparent hereinafter. In this embodiment, the sheet material M is an indefinite length of shade cloth which is fed longitudinally in the direction of feed, with the pleats P being placed a short distance across the cloth in one longitudinal edge region E.

Apparatus 1 includes a frame 2 comprising a base 3 supporting a work bench 4, providing a work support surface 5, and an upright mounting wall 6 spaced from one side of work bench 4. Frame 2 is of a rigid construction and, in this embodiment, is fabricated from metal stock such as steel.

Mounted on wall 6 is a set of pleating rollers 7 between which sheet material M is moved to cause folding of the material M into pleats P. In this embodiment, a pair of rollers 7 are provided although it should be appreciated that additional numbers are envisaged.

Those pleating rollers 7 are mounted for rotation about parallel axes X, extending transverse to the direction of feed A, rollers 7 rotating as material M passes therebetween. Moreover, rollers 7 have peripheral edge regions 8 cooperating with one another to place fan folds or pleats P in the passing material M.

The edge region 8 of each pleating roller 7 has a series of teeth 9 spaced apart about the roller 7. The teeth 9 of each roller 7 mesh with one another, in a spur gear-like manner, at a mesh zone 10. This mesh between the teeth 9 is relative "loose" to provide clearance between the teeth 9 for the material M to pass therebetween. In this way, as the material M moves through the mesh zone 10 it is forced to take up a shape as defined between the meshing teeth 9, thus tending to fold the material in a zig-zag manner.

The teeth 9 are of any suitable shape. Moreover, those teeth 9 may be of any suitable size. It will be appreciated that the shape and size of the teeth 9 will, at least to some extent, influence the nature of material folding and thus the lacing "pitch", i.e. the distance along the sheet material M between successive passes of the flexible line L through the material M. In this embodiment, the teeth 9 are of a U or V shape cross sectional profile, and in the exemplary application, the teeth 9 are shaped and sized so that the lacing pitch is of the order of about 50 mm.

In one embodiment (not shown), the pleating rollers 7 may be sized so as to extend entirely across the material M and thereby form pleats P entirely across the material M. Alternatively (as shown) those rollers 7 may be sized so as to extend only a short distance across the material M path and thereby form pleats P of only a short distance across the material M, such as across edge region E. In this embodiment, a single pair of rollers 7 are provided. However, where the rollers 7 form only short pleats P then two or more pairs of rollers 7 can be provided (not shown) to respectively form two or more series of Pleats P in the material M.

In one embodiment (not shown), the apparatus 1 includes drive means for positively rotating the pleating rollers 7. One or both rollers 7 of each roller pair may be so driven. Any suitable drive means may be provided, including a drive motor, such as an electric motor, coupled directly, or indirectly through a drive transmission, to the roller(s) 7. In this embodiment, however, the pleating rollers 7 are not driven, but mounted for free rotation under influence of the movement of the sheet material M moving in the direction of feed A.

The apparatus 1 includes guide means 11 upstream of the pleating rollers 7 for guiding the sheet material M into the mesh zone 10. The guide means 11 includes guide member 12 having a pair of spaced apart guide plates 13 defining a guide slot 14 therebetween. Guide slot 14 is open ended and open at one side, but is closed along an opposite side by guide wall 15 interconnecting guide plates 13. Guide wall 15 provides a guide surface 16. Guide slot 14 is shaped and sized so as to receive edge region E therethrough and, with the terminal edge thereof contacting guide surface 16, edge region E is aligned with the pleating rollers 7.

Guide member 12 is adjustable to vary the alignment between edge region E and pleating rollers 7, and thus alter the position of lacing of the flexible line L. Adjustment is achieved by way of connecting rod 17 extending from guide member 12 and slidably mounted in mounting block 18. Set screw 19 carried by mounting block 18 engages connecting rod 17 to secure guide member 12 in position but can be rotated to release connecting rod 17 for sliding movement to adjust guide member 12.

Apparatus 1 further includes lacing needle 20 located adjacent but downstream (having regard to the direction of feed A of material M) of pleating rollers 7 so that, as each pleat P is formed in succession, it is pierced by a leading end 21 of needle 20 and received on needle 20. Needle 20 extends generally parallel with the direction of feed A, at least adjacent leading end 21, so that sheet material pleats P pierce and feed transversely onto needle 20.

Lacing needle 20 is arranged so that leading end 21 extends into mesh zone 10 of roller teeth 9. To enable rollers 7 to rotate freely while accommodating leading end 21 at mesh zone 10, teeth 9 are relieved. Thus, as teeth 9 rotate through mesh zone 10, leading end 21 passes through the relieved region so that teeth 9 rotate clear of lacing needle 20. The relieved regions are provided by radially extending relief slots 22 in each of the teeth 9 formed by circumferentially grooving each pleating roller 7.

In one embodiment (not shown), lacing needle 20 may be an integral end segment of the flexible line L to be laced into the sheet material M. Thus, apparatus 1 laces the material M directly onto the flexible line L. This embodiment may be particularly suitable where the flexible line L is relatively stiff, for example wire, and can therefore maintain its presentation to the pleated sheet material M during piercing.

However, in this embodiment (as shown), lacing needle 20 is separate and the flexible line L is connected thereto so that the sheet material M is laced onto needle 20 and then onto the flexible line L. The connection between the flexible line L and needle 20 is toward a trailing end 23 of needle 20. This embodiment is particularly suitable where the flexible line L is not stiff, for example cord, the needle 20 being composed of rigid or stiff material for maintaining proper presentation to the pleated sheet material M. This enables the pleated sheet material M to be initially laced onto needle 20 and then fed downstream onto the flexible line L.

The flexible line may be connected to lacing needle 20 in any suitable manner that provides a relatively smooth transition between needle 20 and line L and thus minimizes snagging of the sheet material M at trailing end 23 as the material M is being fed downstream from needle 20. To that end, a transition tube 24 is provided into which the line L and needle 20 are pushed from opposite open ends. The tube 24 frictionally grips or otherwise connects to the line L and needle 20, and trailing end 23 of needle 20 is of a reduced size so as to receive tube 24 thereon and provide a smooth transition therebetween.

Leading end 21 of lacing needle 20 is shaped to facilitate passage through the sheet material M. To that end, leading end 21 is rounded, or tapered or pointed.

Apparatus 1 further includes a set of feed rollers 25 mounted on mounting wall 6, downstream of pleating rollers 7 for stripping the sheet material M along lacing needle 20 onto transition tube 24 and flexible line L. These feed rollers 25 reduce the prospects of the sheet material M, when pleated onto lacing needle 20, simply remaining bunched adjacent pleating rollers 7. Feed rollers 25 also tend to progressively unfold, unpleat or flatten out the sheet material M in preparation for eventual use. As the sheet material M is flattened out the lacing effect becomes more apparent. As will be described in more detail hereinafter, these feed rollers 25 also provide support for lacing needle 20. In particular, rollers 25 support needle 20 without assistance from pleating rollers 7.

The set of feed rollers 25 includes at least one pair of rollers 25 between which the sheet material M passes for feeding. In this embodiment (as shown), a set of three such pairs of rollers 25*a*, 25*b*, 25*c* are arranged in seriatim, with the material M passing between each roller pair in sequence. The two outer pairs of rollers 25*a*, 25*c* in the roller set are aligned with one another, whilst the intermediate roller pair 25*b* is offset therefrom so that the material M feeds along a tortuous feed path through the feed roller set. This tortuous feed path assists in fixing the position of lacing needle 20.

Feed rollers 25 are mounted for rotation about parallel axes X, extending transverse to the direction of feed A, rollers 25 rotating as material M passes therebetween. Rollers 25 each have a peripheral edge region 26, with regions 26 of adjacent rollers 25 cooperating to define a respective nip 27 therebetween through which the sheet material M is fed. Edge regions 26 have generally smooth peripheral surfaces 28, although in alternative embodiments those regions 26 may be otherwise, such as roughened or toothed, to modify passage of the sheet material M therethrough.

Figure 6:
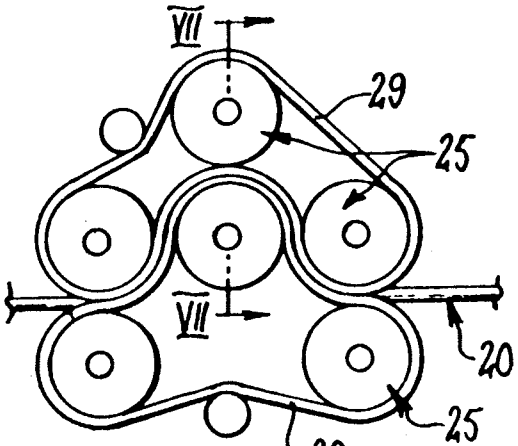
FIG. 6 is a side view of part of the lacing apparatus of FIG. 1 but incorporating a modification.
Figure 7:
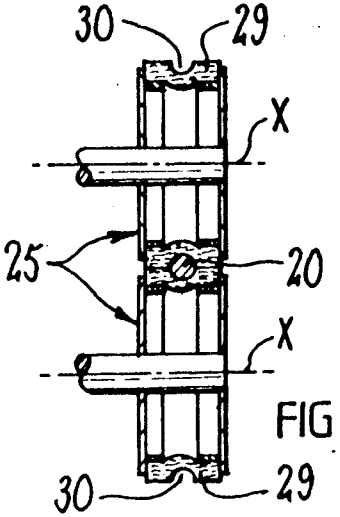
FIG. 7 is a sectional view through Section VII-VII of FIG. 6.

In the embodiment of FIGS. 1 to 5, edge regions 26 directly contact the sheet material M. However, in an alternative embodiment of FIGS. 6 and 7 respective endless feed belts 29 are mounted on corresponding feed rollers 25 of roller pairs 25*a*, 25*b*, 25*c*. On rotation of rollers 25, feed belts 29 circulate so as to move the sheet material M therebetween, stripping it from lacing needle 20. Feed belts 29 are composed of flexible, wear resistant material, such as a felt or felt composite material, and may act to protect rollers 25 against wear.

Feed rollers 25 are also shaped to accommodate lacing needle 20. To that end, rollers 25 are circumferentially grooved so as to form grooves 30, lacing needle 20 extending along a clearance passage, defined by those grooves 20 between feed rollers 25. Lacing needle 20 is solely supported by rollers 25, and in particular is not supported by pleating rollers 7. Because of the off-set arrangement of the feed roller pairs 25*a*, 25*b*, 25*c*, lacing needle 20 is shaped between leading end 21 and trailing end 23 so as to form an inverted U-shaped region 31 and curved regions 32 emerging from each end of inverted U-shaped region 31 and extending toward leading end 21 and trailing end 23, respectively. This shaping enables needle 20 to conform closely to grooves 30 provided in rollers 25. Where feed belts 29 are provided they are positioned between feed rollers 25 and lacing needle 20 and are sufficiently flexible for deformation by lacing needle 20 into grooves 30.

Apparatus 1 includes drive means 33 for positively driving one or more of feed rollers 25. All of rollers 25 are positively rotated by drive means 33, in this embodiment. Any suitable drive means 33 is provided. In this embodiment, drive means 33 includes drive motor 34, such as an electric motor, coupled indirectlY through chain and sprocket drive transmission 35, to feed rollers 25.

In using the apparatus 1 of the present invention sheet material M is moved from a supply source (not shown) in the direction of feed A so as to successively pass through guide member 12, pleating rollers 7 and feed rollers 25. A single strip of sheet material M may be fed through apparatus 1 (as shown) and pleating rollers 7 and lacing needle 20 positioned for lacing of the material M at edge region E. In an alternative arrangement (not shown), two or more material strips M are fed in side-by-side relationship with their adjacent side edge regions E overlapping. In this arrangement, lacing of flexible line L along the overlapping side edge regions E will "sew" the adjacent strips of material M together.

As the sheet material M feeds into mesh zone 10 between pleating rollers 7, the material M is caused to fan fold into pleats P. Individual pleats P are immediately fed by pleating rollers 7 onto lacing needle 20, leading end 21 piercing completely through pleats P.

Successive pleates P are formed in the material M and continuously fed onto lacing needle 20. As each pleat P passes out of mesh zone 10 it is progressively shifted along lacing needle 20 by successive formed pleats P.

The downstream feed rollers 25 and feed belts 29 (where provided) operate to engage and positively move the pleated material M, passing out of mesh zone 10, downstream away from pleating rollers 7. That movement through feed rollers 25 strips material M from needle 20 onto transition tube 24 and flexible line L. Moreover as the material M moves through feed rollers 25, pleats P tend to unfold, leaving flexible line L laced through the material M and the material M in a flattended, ready-to-use condition.

The apparatus of the present application enables rapid and accurate lacing of sheet material, such as shade cloth, with flexible lines such as wire, cord, or fabric. As such, costs associated with material lacing may be minimized.

The apparatus is relatively simple in construction. . Costs of purchase and maintenance of the apparatus may therefore be minimal.

Finally, it is to be appreciated that various modifications and/or alterations may be made to the apparatus without departing from the ambit of the present invention defined in the claims appended hereto.

I claim:

1. Apparatus for lacing a flexible line through sheet material of an indefinite length in a continuous operation, comprising: a set of pleating rollers, each pleating roller having a series of teeth spaced apart about the periphery thereof and the pleating rollers being mounted for rotation so that the teeth of the rollers intermesh in a mesh zone, sheet material feeding through the mesh zone during apparatus use being caused to fold by the teeth into successive pleats; a lacing needle projecting toward the pleating rollers and having a leading end positioned in the mesh zone, sheet material pleats successively formed in the mesh zone being pierced by the leading end and received onto the lacing needle, and the lacing needle being connected to a flexible line for lacing through the sheet material; and, a set of feed rollers positioned downstream of the pleating rollers, each feed roller having a circumferential groove and the feed rollers being mounted for rotation so that the circumferential grooves are in register one with another, the lacing needle being positioned in the circumferential grooves and supported by the feed rollers, whereby rotation of the feed rollers strips the sheet material from the lacing needle and onto the flexible line so that the flexible line is laced through the sheet material.

2. Apparatus as claimed in claim 1, wherein each feed roller has a generally smooth peripheral surface for contacting the sheet material to strip the sheet material from the lacing needle, the feed rollers tending to unfold the sheet material during stripping.

3. Apparatus as claimed in claim 2, wherein the set of feed rollers includes pairs of rollers between which the lacing needle is supported, the feed rollers of each pair forming a nip therebetween through which the sheet material is fed.

4. Apparatus as claimed in claim 3, wherein three pairs of feed rollers are provided in a side-by-side arrangement.

5. Apparatus as claimed in claim 4, wherein the two outer pairs of feed rollers are aligned with one another whilst the intermediate feed roller pair is offset therefrom, the lacing needle being shaped to extend through the feed roller set between each pair of rollers.

6. Apparatus as claimed in claim 1, wherein the lacing needle has a trailing end, and between the leading and trailing ends thereof has an inverted U-shaped region which extends along the circumferential groove of one feed roller.

7. Appartus as claimed in claim 6, wherein the lacing needle has curved regions emerging from each end of the inverted U-shaped region and extending toward the leading and trailing ends, respectively, of the lacing needle, the curved regions extendinq alonq respective circumferential grooves of separate feed rollers adjacent the one feed roller.

8. Apparatus as claimed in claim 1, and further including at least one endless feed belt mounted on at least some of the feed rollers for endless circulation thereabout, the feed belt moving between the feed rollers and sheet material to contact and strip the sheet material from the lacing needle.

9. Apparatus as claimed in claim 8, wherein a pair of endless feed belts are provided, each feed belt being mounted on different feed rollers so that the lacing needle and sheet material extend between the feed belts.

10. Apparatus as claimed in claim 8, wherein each feed belt is flexible for deformation by the lacing needle so as to be received in the circumferential grooves.

11. Apparatus as claimed in claim 1, wherein the pleating teeth are relieved so as to provide a clearance into which the leading end of the lacing needle is received as the teeth move through the mesh zone.

12. Apparatus as claimed in claim 11, wherein each pleating roller is circumferentially grooved so that the pleating teeth have radially extending relief slots therein.

13. Apparatus as claimed in claim 1, and further including drive means for rotatably driving at least one of the feed rollers.

14. Apparatus as claimed in claim 14, wherein the drive means is coupled to each of the feed rollers for positive driving thereof.

15. Apparatus as claimed in claim 1, wherein the pleating rollers are mounted for free rotation, the pleating rollers rotating under action of movement of the sheet material through the mesh zone.

16. Apparatus as claimed in claim 1, wherein the lacing needle has a trailing end, and further including a transition tube having one end connectable to the trailing end and an opposite end for receiving an end region of the flexible line therein, the transition tube and trailing end being shaped to provide a smooth transition therebetween for uninhibited movement of the sheet material being stripped from the lacing needle onto the transition tube.

17. Apparatus as claimed in claim 1, and further comprising guide means by which the sheet material is guided into the mesh zone between the pleating rollers.

18. Apparatus as claimed in claim 17, wherein the guide means includes a stationary guide member having a guide surface against which a longitudinal edge region of passing sheet material contacts in order to align the sheet material with the pleating rollers and lacing needle.

19. Apparatus as claimed in claim 18, wherein the guide member has an open ended guide slot through which the longitudinal edge region moves, the guide surface defining a closed side of the guide slot.

* * * * *